US009228371B2

(12) United States Patent
Volum

(10) Patent No.: US 9,228,371 B2
(45) Date of Patent: Jan. 5, 2016

(54) ANCHOR SOCKET SYSTEM FOR POSTS

(71) Applicant: Patrick J. Volum, Miami, FL (US)

(72) Inventor: Patrick J. Volum, Miami, FL (US)

( * ) Notice: Subject to any disclaimer, the term of this patent is extended or adjusted under 35 U.S.C. 154(b) by 33 days.

(21) Appl. No.: 14/179,126

(22) Filed: Feb. 12, 2014

(65) Prior Publication Data

US 2014/0227040 A1 Aug. 14, 2014

Related U.S. Application Data

(60) Provisional application No. 61/763,607, filed on Feb. 12, 2013.

(51) Int. Cl.
*E21D 21/00* (2006.01)
*E04H 12/22* (2006.01)

(52) U.S. Cl.
CPC ..... *E04H 12/2253* (2013.01)

(58) Field of Classification Search
USPC ..... 405/244, 259.1, 259.4; 52/169.13, 297, 52/298, 704; 256/65.14; 248/530, 532, 248/156
See application file for complete search history.

(56) References Cited

U.S. PATENT DOCUMENTS

| | | | | |
|---|---|---|---|---|
| 4,784,530 | A * | 11/1988 | Price, Jr. | 405/259.3 |
| 5,660,013 | A | 8/1997 | Saldarelli et al. | |
| 6,684,588 | B1 | 2/2004 | Jones | |
| 7,219,872 | B2 | 5/2007 | Walker | |
| 2008/0008555 | A1 | 1/2008 | Ardern | |

* cited by examiner

*Primary Examiner* — Sean Andrish
(74) *Attorney, Agent, or Firm* — Robert M. Downey, P.A.

(57) ABSTRACT

An anchor socket system for vertically supporting a post includes external and internal, open-ended cylinders, wherein the external cylinder includes first and second semi-cylinder halves each having mirroring tapers and semi-annular upper rims on each respective inner facing wall. Tightening bolts in communication with the internal and external cylinders are rotated to raise the internal cylinder relative to the external cylinder, thereby causing tapered wedges on the outer facing surface of the internal cylinder to exert pressure against the corresponding tapers on the inner facing surface of the external cylinder. As the diameter of the internal cylinder contracts, pressure is exerted against a post by the inner facing walls of the internal cylinder while the outer facing walls of the external cylinder halves simultaneously exert pressure against the inner facing surface of a core-drilled hole, thereby locking the anchor socket and post into place within the core-drilled hole.

18 Claims, 5 Drawing Sheets

ANCHOR SOCKET SYSTEM FOR POSTS

BACKGROUND OF THE INVENTION

This non-provisional patent application is based on provisional patent application Ser. No. 61/763,607 filed on Feb. 12, 2013.

1. Field of the Invention

The present invention relates to an anchor socket for anchoring various kinds of posts and, more particularly, to a groutless anchor socket system that can be easily installed and replaced without damaging the surrounding area.

2. Discussion of the Related Art

Anchor sockets are used to support in-ground installation of various kinds of posts, such as lamp posts, fence posts, davits, tennis net posts, and pool railing and ladder posts. Installation of conventional anchor sockets requires the use of cement and, as a result, multiple visits by the installer due to time needed for the cement to cure. A common problem associated with conventional anchor sockets is the likelihood that removal of the anchor socket, such as in the event of failure due to corrosion, will be required. Removal of anchor sockets that are cemented into the ground is a labor intensive task that requires damaging the ground surface within which the anchor socket has been permanently installed. Once the anchor socket has been removed, replacement with a new anchor socket requires re-cementing and waiting for the cement to cure. Additionally, a number of conventional anchor sockets require drilling of two holes that partially overlap each other in order to accommodate the body structure of the anchor socket, which further necessitates that the center of the anchor socket does not coincide with the center of the post mounting location. Such anchor sockets require extensive calculation time and installation time, in addition to causing further damage to the ground surface within which the holes are being drilled.

In view of the shortcomings associated with conventional anchor sockets, including the problems described above, there is a need for a groutless anchoring system for providing a more efficient and effective installation process of posts, which further allows for removal and replacement of an individual anchor socket without damaging the surrounding area.

OBJECTS AND ADVANTAGES OF THE INVENTION

Considering the foregoing, it is a primary object of the present invention to provide an anchor socket system that does not require cement for installation of the anchor socket.

It is a further object of the present invention to provide an anchor socket system that can be easily installed and replaced without damaging the surrounding area.

It is a further object of the present invention to provide an anchor socket system that requires a single core-drilled hole that has a smaller diameter than conventional core-drilled holes sized to accommodate conventional anchor sockets.

These and other objects and advantages of the present invention are more readily apparent with reference to the following detailed description and the accompanying drawings.

SUMMARY OF THE INVENTION

The present invention is directed to an anchor socket system for use in combination with a post, such as a lamp post, a fence post, a davit post, a tennis net post, and pool railing and ladder posts, wherein the anchor socket is installed in-ground and vertically supports the post. A preferred embodiment of the anchor socket system includes external and internal, open-ended cylinders, wherein the external cylinder comprises first and second semi-cylinder halves sized and structured to meet along the center line of the external cylinder, each including one or more mirroring tapers and semi-annular rims along its respective inner facing wall. After an appropriately sized anchor socket is fitted into a hole core-drilled into the ground surface and a post has been inserted within the opening of the interior cylinder, tightening bolts in communication with the external and internal cylinders are rotated to raise the internal cylinder relative to the external cylinder, thereby causing the tapered wedges on the outer facing walls of the internal cylinder to exert pressure against the corresponding tapers on the inner facing surface of the external cylinder. As the diameter of the internal cylinder contracts, pressure is exerted against a post by the inner facing walls of the internal cylinder while the outer facing walls of the external cylinder halves simultaneously exert pressure against the inner facing surface of a core-drilled hole, thereby locking the anchor socket and post into place within the core-drilled hole. After completing operation of rotating the tightening bolts, the anchor socket is locked into place and the post is ready for use. The anchor socket and post may be removed by turning the tightening bolts in the opposite direction to alleviate the pressure being exerted on the post and inner facing walls of the core-drilled hole. An alternative embodiment of the anchor socket system includes external and internal, open-ended cylinders, wherein a threaded nut sized to fit around a threaded collar on the inner cylinder is used to raise the internal cylinder within the external cylinder.

BRIEF DESCRIPTION OF THE DRAWINGS

For a fuller understanding of the nature of the present invention, reference should be made to the following detailed description taken in conjunction with the accompanying drawing in which.

Like reference numerals refer to like parts throughout the several views of the drawings.

DETAILED DESCRIPTION OF THE PREFERRED EMBODIMENTS

Referring to the several views of the drawings, the anchor socket system of the present invention is shown and is generally indicated as 10.

Figure 1:
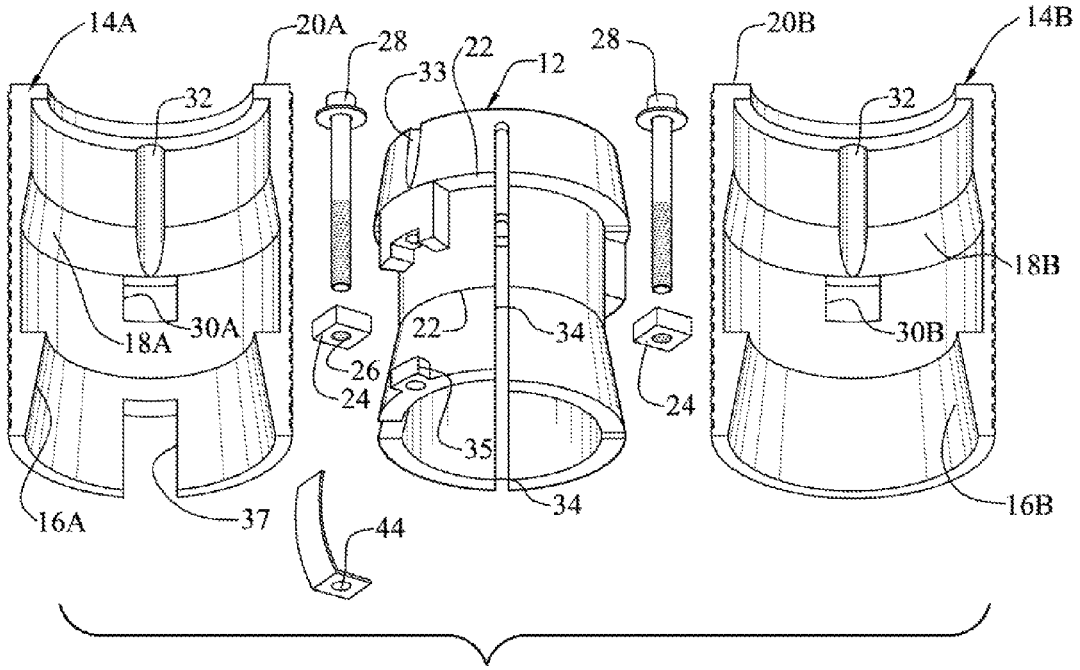
FIG. 1 is a perspective view illustrating a preferred embodiment of the anchor socket system of the present invention when disassembled, including two halves of the outer cylinder, the inner cylinder, two tightening bolts, two nuts, and a grounding clip.
Figure 2:
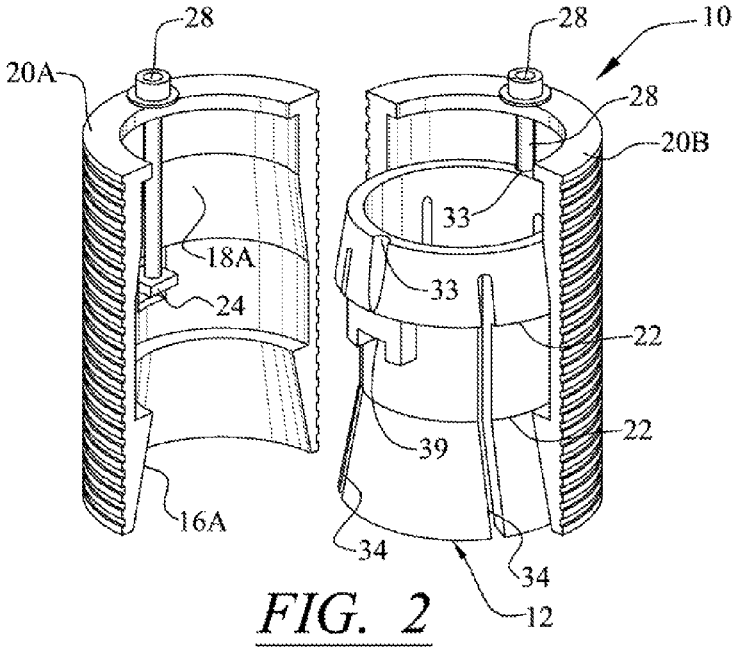
FIG. 2 is a perspective view illustrating a preferred embodiment of the anchor socket system of the present invention when partially assembled.
Figure 3:
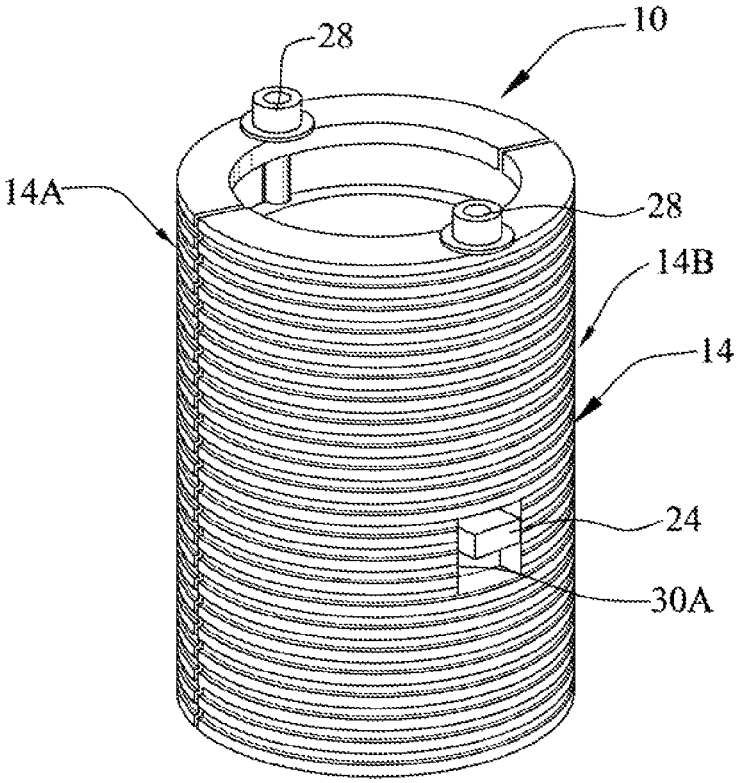
FIG. 3 is a perspective view illustrating a preferred embodiment of the anchor socket system of the present invention when assembled.

Referring to FIGS. 1-3, a preferred embodiment of the anchor socket system 10 includes an internal cylinder 12 and an external cylinder 14 formed from a first semi-cylinder half 14A and a second semi-cylinder half 14B being sized and structured to meet along the center line of the external cylinder 14. Each semi-cylinder half 14A and 14B includes one or more mirroring tapers 16A and 16B on the respective inner facing walls 18A and 18B, as well as mirroring semi-annular rims 20A and 20B at the top of each respective semi-cylinder half 14A and 14B. Each pairing of tapers 16A and 16B and semi-annular rims 20A and 20B extend inwards and are in vertical alignment relative to each other. The internal cylinder 12 includes tapered wedges 22 that correspond with tapers 16A and 16B on semi-cylinder halves 14A and 14B when the internal cylinder 12 and external cylinder 14 are combined. Square nuts 24 having threaded inner passages 26 sized for engaged receipt of tightening bolts 28 are sized to be supported within windows 30A and 30B on each semi-cylinder half 14A and 14B. In a preferred embodiment, a protrusion 35 on the internal cylinder 12 is sized and configured for fitting in slot 37 on the external cylinder 14 for ensuring proper alignment of the internal cylinder 12 and external semi-cylinder halves 14A and 14B when assembled. Opposing slotted ridges 39 on the outer facing wall of internal cylinder 12 are sized and configured for slotted receipt of a portion of a respective square nut 24.

Referring specifically to FIGS. 1 and 2, tightening bolts 28 are each sized for insertion within an opening 32 on each semi-annular rim 20A and 20B. Each opening 32 is in vertical alignment with the respective windows 30A and 30B. Grooves 33 on opposing sides of the internal cylinder 12 are sized and configured for guided receipt of the tightening bolts 28, which are held in vertical alignment between a respective opening 32 and window 30A or 30B. The internal cylinder 12 includes a plurality of slits 34 extending upwards from the bottom end of the cylinder 12 and ending at a location below the top of the cylinder 12.

Referring to FIG. 3, an assembled anchor socket system 10 includes the internal cylinder 12, the external cylinder 14, tightening bolts 28 and square nuts 24 partially held in respective windows 30A and 30B on the external cylinder 14 and slotted ridges 9 on the internal cylinder 12.

Figure 4:
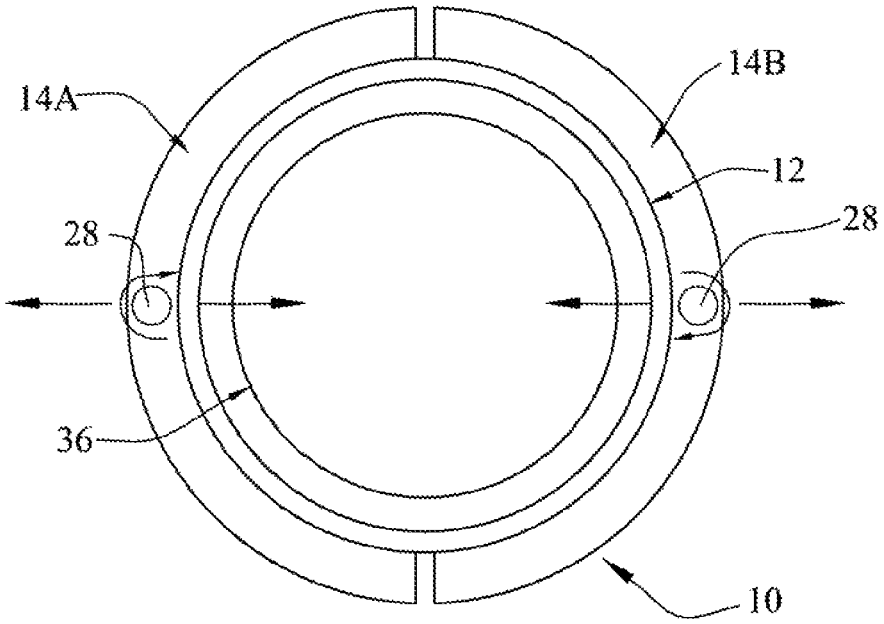
FIG. 4 is a top plan view illustrating operation of the tightening bolts to install a post into a core-drilled hole using the anchor socket system of the present invention.
Figure 5A:
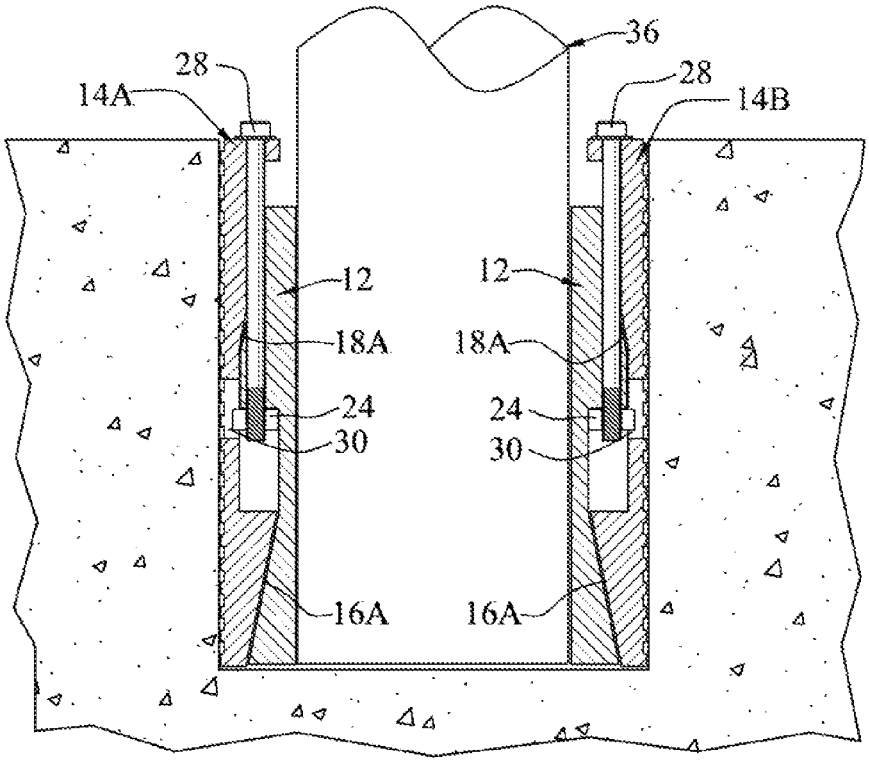
FIG. 5A is a side elevational view, shown in cross-section, illustrating the anchor socket system of the present invention.
Figure 5B:
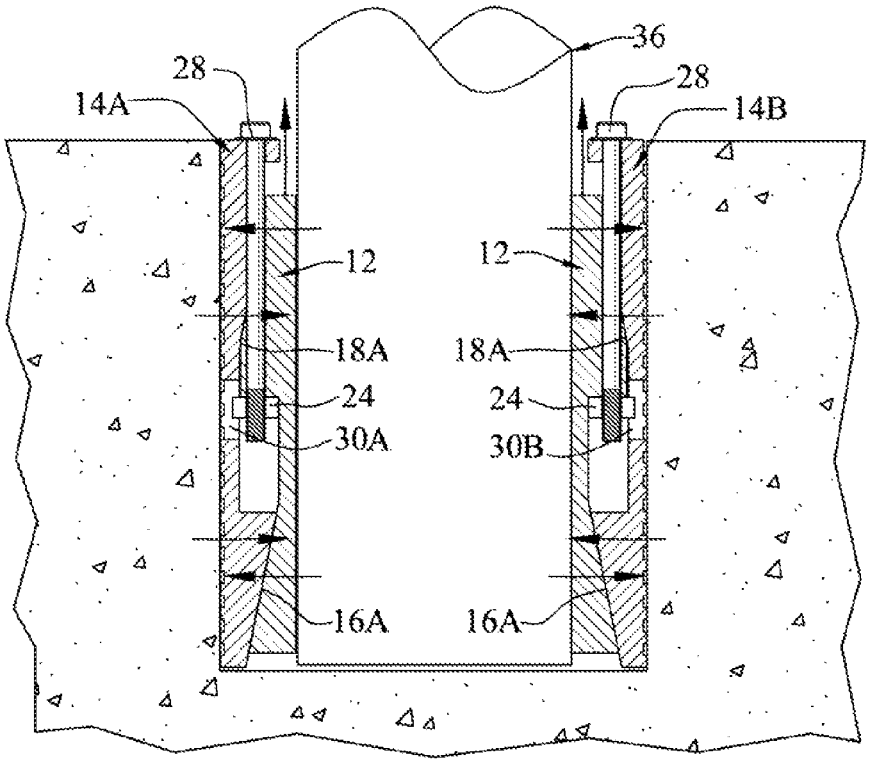
FIG. 5B is a side elevational view, shown in cross-section, illustrating operation of the tightening bolts to install a post into a core-drilled hole using the anchor socket system of the present invention.

Referring to FIGS. 4-5B, installation of the anchor socket 10 requires core-drilling a hole into the ground surface having approximately the same or slightly larger circumference than the anchor socket 10 (approximately 3 inches in diameter). The anchor socket 10 is inserted into the hole, after which a post 36 may be inserted into the open top end of the interior cylinder 12. The post 36 and core-drilled hole have common centers, unlike traditional anchor sockets, which saves the user the time typically required to calculate the required distance between placement of multiple core-drilled holes.

Rotation of the tightening bolts 28 in the clockwise direction causes square nuts 24 to move upwards, as friction between the square nuts 24 and the windows 30A and 30B and slotted ridges 39 impede rotation of the square nuts 24, thereby causing the square nuts 24 to ride up the length of the threaded portion of the tightening bolt 28. Continued rotation of the tightening bolts 28 causes the square nuts 24 to rise and press against the surface of the respective slotted ridges 39, thereby causing the internal cylinder 12 to rise within the external cylinder 14. As the internal cylinder 12 rises, tapered wedges 22 exert pressure against respective tapers 16A and 16B, thereby causing the internal cylinder 12 to contract and exert pressure on the post 36. The plurality of slits 34 on internal cylinder 12 permit the cylinder 12 to contract tightly around the post 36 as the bolts 28 are tightened. The external cylinder halves 14A and 14B are simultaneously forced apart as the internal cylinder 12 rises and exert pressure against the inner facing surface of the core-drilled hole. The tightening bolts 28 are rotated in the clockwise direction until the anchor socket 10 is secured within the core-drilled hole and the post 36 is tightly secured against the inner facing walls of internal cylinder 12.

The anchor socket 10 and post 36 may be removed, from the core-drilled hole by turning the tightening bolts 28 in the opposite direction (counter-clockwise) to alleviate the pressure being exerted on the post 36 by the internal cylinder 12 and inner facing walls of the core-drilled hole by the external cylinder 14.

Figure 6:
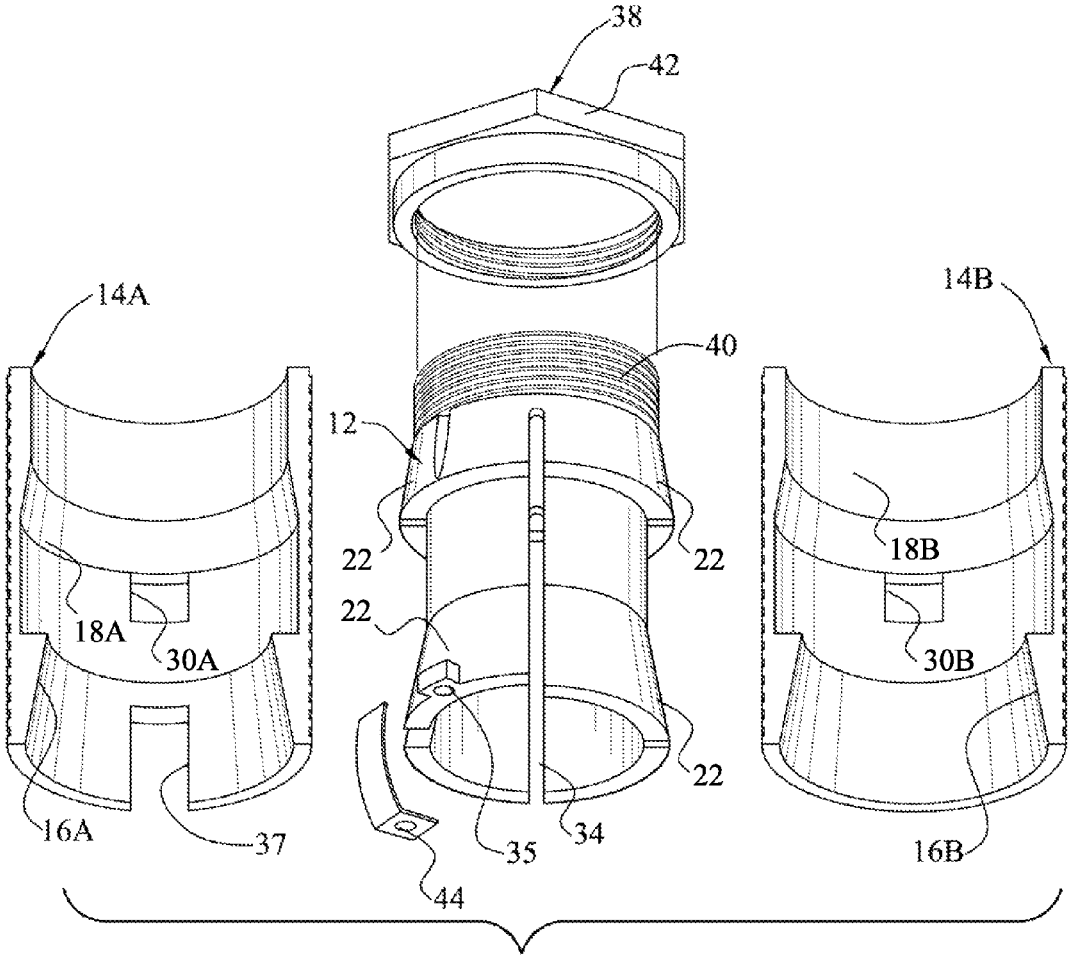
FIG. 6 is a perspective view illustrating another embodiment of the anchor socket system of the present invention when disassembled, including two halves of the outer cylinder, the inner cylinder, a threaded nut, and a grounding clip.
Figure 7:
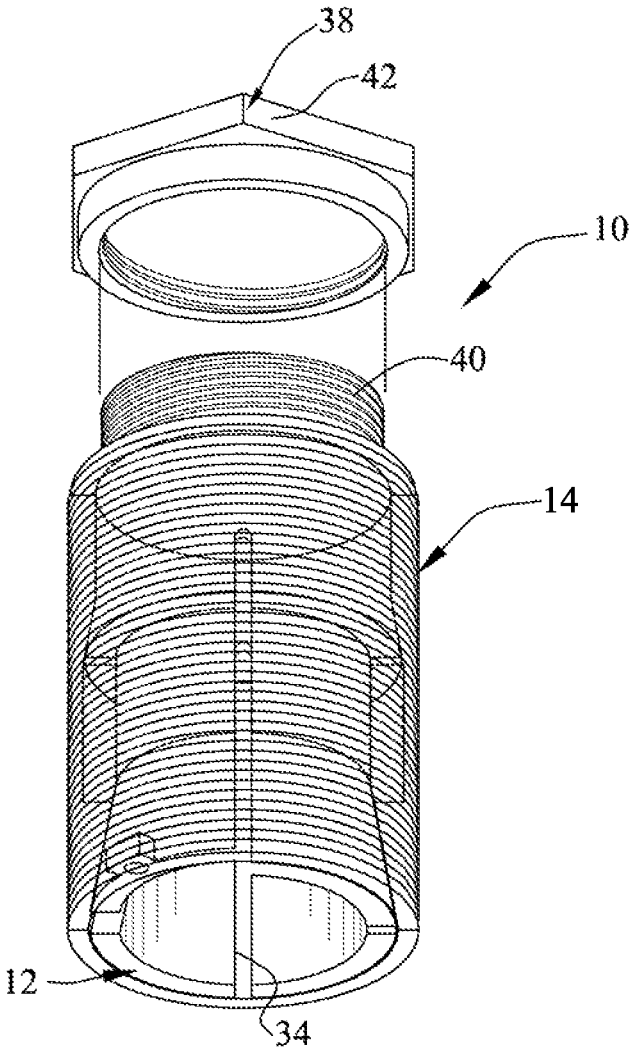
FIG. 7 is a perspective view illustrating an alternative embodiment of the anchor socket system of the present invention when partially assembled.

Referring to FIGS. 6 and 7, an alternative embodiment of the anchor socket system 10 is illustrated. The alternative embodiment of the anchor socket system 10 includes an open-ended internal cylinder 12 and an open-ended external cylinder 14 that is split into halves 14A and 14B. A threaded nut 38 is sized to engage threaded collar 40 on the internal cylinder 12. The outer rim 42 of the threaded nut 38 extends outwards to overlap the external cylinder 14. In operation, as the threaded nut 38 is rotated in the clockwise direction, the internal cylinder 12 rises, causing the tapered wedges 22 to exert pressure onto respective tapers 16A and 16B and causing the external cylinder halves 14A and 14B to expand outwardly away from each other while the internal cylinder 12 contracts, thereby exerting outward pressure against the core-drilled hole and inward pressure against, an engaged post by the inner facing walls of the internal cylinder 12. The outer rim 42 of the threaded nut 38 prevents the external cylinder halves 14A and 14B from rising as the threaded nut 38 is rotated. The external cylinder halves 14A and 14B simultaneously separate as the inner cylinder 12 rises and exert pressure against the inner facing walls of the core-drilled hole. The plurality of slits 34 on internal cylinder 12 permit the cylinder 12 to contract tightly around the post 36 as the threaded nut 38 is tightened. As shown in FIGS. 6 and 7, the alternative embodiment of the anchor socket 10 includes at least four slits 34 along the length of the internal cylinder 12 for permitting flexion and contraction of the internal cylinder 12 against the post 36 when the threaded nut 38 is rotated in the clockwise direction until the anchor socket 10 is stable and tightly anchored within the core-drilled hole and the post 36 is tightly secured against the inner facing walls of internal cylinder 12.

Each embodiment of the anchor socket system 10 is preferably made from non-metallic materials, such as plastic, for the purpose of preventing corrosion. As illustrated in FIGS. 1 and 5, a brass connector 44 may be attached to the protrusion 35 on the base of the anchor socket 10 with a screw fastener (not shown) to enable grounding when the anchor socket system 10 is used in conjunction with a metallic post 36, such as a pool railing post or pool ladder post. Importantly, as the anchor socket 10 is easily removable, re-connection of a metallic post 36 to a grounding cable, when necessary, may be performed without causing damage to the surrounding ground surface.

While the present invention has been shown and described in accordance with several preferred and practical embodiments, it is recognized that departures from the instant disclosure are fully contemplated within the spirit and scope of the invention.

What is claimed is:

1. An anchor socket device for supporting a post in a core-drilled hole in a ground surface, and said anchor socket device comprising:

an internal cylinder having an inner facing wall defining a passage between top and bottom open ends of said internal cylinder and including at least one annular tapered wedge, an outer facing wall and a plurality of vertically aligned slits extending between the inner and outer facing walls and said vertically aligned slits beginning at the bottom end of said internal cylinder and terminating at a location below the top end of said internal cylinder, and the passage being sized and configured for engaged receipt of the post through the top open end;

an external cylinder comprising first and second external semi-cylinder halves each having an inner facing wall and an outer facing wall, and each of said first and second external semi-cylinder halves including at least one taper extending from an inner facing wall, and said first and second semi-cylinder halves being sized and configured to fit around said internal cylinder when said first and second semi-cylinder halves are connected to form said external cylinder, and wherein each one of the at least one taper is above a respective one of the at least one tapered wedges; and at least one tightening member being structured and disposed for raising said internal cylinder relative to said external cylinder and causing the at least one annular tapered wedge to exert pressure on the at least one taper to force the inner facing wall of said internal cylinder to contract against the outer surface of the post while simultaneously forcing the outer facing wall of said external cylinder to expand against the inner facing surface of the core-drilled hole.

2. The anchor socket device as recited in claim 1 wherein each of said external semi-annular cylinder halves further comprises a semi-annular upper rim that is sized and configured to extend over the top open end of said internal cylinder when said external semi-cylinder halves are connected, and each of said semi-annular upper rims having an opening.

3. The anchor socket device as recited in claim 2 wherein said at least one tightening member comprises a first and second tightening bolt each having a threaded distal end sized for passage through the opening on a respective one of said semi-annular upper rims.

4. The anchor socket device as recited in claim 3 further comprising:

a first and second non-circular nut each having a threaded inner passage that is sized and configured for threaded receipt of the threaded distal end of a corresponding one of said first and second tightening bolts;

said first and second semi-cylinder halves each including a non-circular window extending between the inner and outer facing walls, and each of said non-circular windows being sized and configured for fitted, engaged receipt of at least a portion of one of said first and second non-circular nuts for impeding rotation of said first and second non-circular nuts when the corresponding one of said first and second tightening bolts is rotated;

said internal cylinder including a first and second slotted ridge extending therefrom, and each of said first and second slotted ridges being sized and configured for fitted, engaged receipt of at least a portion of a respective one of said non-circular nuts for impeding rotation of said first and second non-circular nuts when the corresponding one of said first and second tightening bolts is rotated; and wherein rotation of said first and second tightening bolts in one direction causes said first and second non-circular nuts to move upwards along the threaded distal end of the respective one of said first and second tightening bolts and press against a top surface of the respective one of said first and second slotted ridges for raising said internal cylinder relative to said external cylinder and causing the at least one annular tapered wedge to exert pressure on the at least one taper to force the inner facing wall of said internal cylinder to contract against the outer surface of the post while simultaneously forcing the outer facing wall of each of said external semi-cylinders to exert pressure against the inner facing surface of the core-drilled hole.

5. The anchor socket device as recited inn claim 4 wherein said internal cylinder further comprises a first and second groove each being sized and configured for guided receipt of a respective one of said first and second tightening bolts between the opening on a respective one of said semi-annular upper rims and said first and second slotted ridges.

6. The anchor socket device as recited in claim 1 wherein the outer facing wall of said internal cylinder has a threaded top end.

7. The anchor socket device as recited in claim 6 wherein said at least one tightening member is a nut having an upper rim and a threaded interior surface extending between an open top end and an open bottom end, said threaded interior surface being sized and configured for threaded engagement with the threaded top end of said internal cylinder, and said upper rim being sized and configured to extend over a top end of said external cylinder; and wherein rotation of said nut in one direction causes said internal cylinder to move upwards within the threaded interior surface of said nut and the upper rim to press against the top end of said external cylinder for raising said internal cylinder relative to said external cylinder and causing the at least one annular tapered wedge to exert pressure on the at least one taper to force the inner facing wall of said internal cylinder to contract against the outer surface of the post while simultaneously forcing the outer facing wall of each of said external semi-cylinders to exert pressure against the inner facing surface of the core-drilled hole.

8. The anchor socket device as recited in claim 1 further comprising:

an open slot extending between the inner and outer facing walls of one of said external semi-cylinder halves; and a protrusion on the outer facing wall of said internal cylinder that is sized and configured for engaged receipt within the open slot for aligning said internal cylinder and said external semi-cylinder halves when connected.

9. The anchor socket device as recited in claim 1 further comprising a brass connector that is structured and disposed for grounding an electrical current that passes through the post.

10. The anchor socket device as recited in claim 1 wherein said internal cylinder and said first and second external semi-cylinder halves are made from plastic.

11. An anchor socket device for supporting a post in a core-drilled hole in a ground surface, and said anchor socket device comprising:

an internal cylinder having an inner facing wall defining a passage between top and bottom open ends of said internal cylinder and including at least one annular tapered wedge, an outer facing wall and a plurality of vertically aligned slits extending between the inner and outer facing walls and said vertically aligned slits beginning at the bottom end of said internal cylinder and terminating at a location below the top end of said internal cylinder, and the passage being sized and configured for engaged receipt of the post through the top open end;

an external cylinder comprising first and second external semi-cylinder halves each having an inner facing wall and an outer facing wall, and each of said first and second external semi-cylinder halves including at least one taper extending from an inner facing wall, and said first and second semi-cylinder halves being sized and configured to fit around said internal cylinder when said first and second semi-cylinder halves are connected to form said external cylinder, and wherein each one of the at least one taper is above a respective one of the at least one tapered wedges;

a semi-annular upper rim on each of said first and second external semi-cylinder halves, said semi-annular upper rim being sized and configured to extend over the top open end of said internal cylinder when each of said external semi-cylinder halves are connected, and each of said semi-annular upper rims having an opening;

a first and second tightening bolt each having a threaded distal end sized for passage through the opening on a respective one of said semi-annular upper rims;

a first and second non-circular nut each having a threaded inner passage that is sized and configured for threaded receipt of the threaded distal end of a corresponding one of said first and second tightening bolts;

said first and second semi-cylinder halves each including a non-circular window extending between the inner and outer facing walls, and each of said non-circular windows being sized and configured for fitted, engaged receipt of at least a portion of one of said first and second non-circular nuts for impeding rotation of said first and second non-circular nuts when the corresponding one of said first and second tightening bolts is rotated;

said internal cylinder including a first and second slotted ridge extending therefrom, and each of said first and second slotted ridges being sized and configured for fitted, engaged receipt of at least a portion of a respective one of said non-circular nuts for impeding rotation of said first and second non-circular nuts when the corresponding one of said first and second tightening bolts is rotated; and wherein rotation of said first and second tightening bolts in one direction causes said first and second non-circular nuts to move upwards along the threaded distal end of the respective one of said first and second tightening bolts and press against a top surface of the respective one of said first and second slotted ridges for raising said internal cylinder relative to said external cylinder and causing the at least one annular tapered wedge to exert pressure on the at least one taper to force the inner facing wall of said internal cylinder to contract against the outer surface of the post while simultaneously forcing the outer facing walls of each of said external semi-cylinders to exert pressure against the inner facing surface of the core-drilled hole.

12. The anchor socket device as recited in claim 11 further comprising:

an open slot extending between the inner and outer facing walls of one of said external semi-cylinder halves; and a protrusion on the outer facing wall of said internal cylinder that is sized and configured for engaged receipt within the open slot for aligning said internal cylinder and said external semi-cylinder halves when connected.

13. The anchor socket device as recited in claim 11 further comprising a brass connector that is structured and disposed for grounding an electrical current that passes through the post.

14. The anchor socket device as recited in claim 11 wherein said internal cylinder and said first and second external semi-cylinder halves are made from plastic.

15. An anchor socket device for supporting a post in a core-drilled hole in a ground surface, and said anchor socket device comprising:

an internal cylinder having an inner facing wall defining a passage between top and bottom open ends of said internal cylinder and including at least one annular tapered wedge, an outer facing wall having a threaded top end, and a plurality of vertically aligned slits extending between the inner and outer facing walls and said vertically aligned slits beginning at the bottom end of said internal cylinder and terminating at a location below the top end of said internal cylinder, and the passage being sized and configured for engaged receipt of the post through said top open end;

an external cylinder comprising first and second external semi-cylinder halves each having an inner facing wall and an outer facing wall, and each of said first and second external semi-cylinder halves including at least one taper extending from an inner facing wall, and said first and second semi-cylinder halves being sized and configured to fit around said internal cylinder when said first and second semi-cylinder halves are connected to form said external cylinder, and wherein each one of the at least one taper is above a respective one of the at least one tapered wedges;

a nut having an upper rim and a threaded interior surface extending between an open top end and an open bottom end, said threaded interior surface being sized and configured for threaded engagement with the threaded top end of said internal cylinder, and said upper rim being sized and configured to extend over a top end of said external cylinder; and wherein rotation of said nut in one direction causes said internal cylinder to move upwards within the threaded interior surface of said nut and the upper rim to press against the top end of said external cylinder for raising said internal cylinder relative to said external cylinder and causing the at least one annular tapered wedge to exert pressure on the at least one taper to force the inner facing wall of said internal cylinder to contract against the outer surface of the post while simultaneously forcing the outer facing wall of each of said external semi-cylinders to exert pressure against the inner facing surface of the core-drilled hole.

16. The anchor socket device as recited in claim 15 further comprising:

an open slot extending between the inner and outer facing walls of one of said external semi-cylinder halves; and a protrusion on the outer facing wall of said internal cylinder that is sized and configured for engaged receipt within the open slot for aligning said internal cylinder and said external semi-cylinder halves when connected.

17. The anchor socket device as recited in claim 15 further comprising a brass connector that is structured and disposed for grounding an electrical current that passes through the post.

18. The anchor socket device as recited in claim 15 wherein said internal cylinder and said first and second external semi-cylinder halves are made from plastic.

* * * * *